US005465598A

United States Patent [19]

Hirai et al.

[11] Patent Number: 5,465,598

[45] Date of Patent: Nov. 14, 1995

[54] METHOD FOR FORMING AN ANNULAR MEMBER

[75] Inventors: Yukio Hirai; Kouzou Kanayama, both of Nagoya; Kenji Yoshii; Kiyotoshi Iwasaki, both of Toyohashi; Isao Kanai, Yokohama; Shin Suzuki, Ayase, all of Japan

[73] Assignees: Topy Kogyo Kabushiki Kaisha; Shunso Ishihara, both of Tokyo, Japan

[21] Appl. No.: 329,783

[22] Filed: Oct. 27, 1994

Related U.S. Application Data

[63] Continuation of Ser. No. 74,472, Jun. 11, 1993, abandoned.

[30] Foreign Application Priority Data

Jun. 12, 1992 [JP] Japan ..... 4-177667
Jun. 12, 1992 [JP] Japan ..... 4-177668

[51] Int. Cl.[6] ..... B21H 1/06

[52] U.S. Cl. ..... 72/84; 72/115; 72/67

[58] Field of Search ..... 72/67, 74, 84, 72/80, 111, 115

[56] References Cited

U.S. PATENT DOCUMENTS

| | | | |
|---|---|---|---|
| 479,181 | 7/1892 | Brown et al. | 72/84 |
| 859,317 | 7/1907 | Miller et al. | 72/84 |
| 2,942,567 | 6/1960 | Kargard et al. . | |
| 2,983,033 | 5/1961 | Cox | 72/358 |
| 3,690,278 | 9/1972 | Rautavalta | 72/74 |

FOREIGN PATENT DOCUMENTS

| | | | |
|---|---|---|---|
| 823135 | 10/1951 | Germany . | |
| 1149683 | 6/1963 | Germany . | |
| 2557764 | 7/1976 | Germany . | |
| 1652653 | 5/1992 | Germany . | |
| 279332 | 12/1986 | Japan | 72/67 |
| 199041 | 8/1988 | Japan | 72/67 |
| 1258567 | 9/1986 | U.S.S.R. | 72/111 |

*Primary Examiner*—Lowell A. Larson
*Attorney, Agent, or Firm*—Cushman, Darby & Cushman

[57] ABSTRACT

An annular member is placed on a forming profile of a convex die without fixing the annular member to the convex die. Then, the convex die is moved toward a concave die which has an axis inclining with respect to an axis of the convex die. When the convex die is moved toward the concave die, the concave die is revolved around the axis of the convex die. The concave die does not revolve about its own axis. Revolving the concave die around the axis of the convex die may be replaced by forcibly rotating the convex die about its own axis. When a compression load is imposed on the annular member, opposed ends of the annular member are formed simultaneously.

15 Claims, 4 Drawing Sheets

METHOD FOR FORMING AN ANNULAR MEMBER

This is a continuation of application Ser. No. 08/74,472, filed on Jun. 11, 1993, which was abandoned upon the filing hereof.

BACKGROUND OF THE INVENTION

1. Field of the Invention

The present invention relates to a method and apparatus for forming an annular member wherein axially opposed ends of the annular member are formed simultaneously. One end is enlarged in diameter and the other is reduced in diameter. This forming method is also available for manufacturing automobile wheel disks from cylindrical members. Such cylinders are formed by rounding a flat plate and butt-welding along the longitudinal seam.

2. Description of the Prior Art

Various forming methods for enlarging or reducing a single end of a tube are disclosed in, for example, "Tube Forming Techniques" edited by Tube Forming Group of Japan Plastic Forming Engineering Association (published August 1986) and "Method for Forming a Pipe End and Recent Trend Therefor", Pages 18–24, Vol. 26-3 of "Press Techniques".

These prior art forming methods are summarized in FIGS. 3–10. More particularly, FIG. 3 illustrates a press-forming method wherein a pipe 22 is pushed against a mandrel 24 so that an end portion of the pipe is enlarged in diameter. FIG. 4 illustrates a spinning method wherein a spinning roll 28 is pushed against a pipe 26 so that the pipe is reduced to a diameter of the rotating mandrel 30. FIG. 5 illustrates a roller-forming method wherein a pipe 32 is pushed against a mandrel 34 having rollers 36 so that an end of the pipe is enlarged in diameter. FIGS. 6 and 7 illustrate a swaging method wherein a pair of dies 40 are repeatedly pushed against a pipe 38 in a direction perpendicular to the longitudinal axis of the pipe. After each stroke of the disks 40, they are turned incrementally around the pipe 38.

Finally, FIGS. 8 through 10 illustrate a method for forming a pipe end by using an oscillating-type die. More particularly, as illustrated in FIG. 8, a die 42 having an axis inclining with respect to a predetermined axis is allowed to freely rotate about the inclining axis. During formation, as illustrated in FIG. 9, the pipe 44 is chucked by a chuck 48 and is pushed against the inclining die 46 (which corresponds to the die of FIG. 8). The die 46 is forcibly rotated about the inclining axis by the rotation of the chuck 48 resulting in diameter enlargement of the pipe end. When a pipe end is reduced in diameter, as illustrated in FIG. 10, a pipe 44 is chucked and rotated by a chuck 54 and is pushed by a die 52 having an axis inclining with respect to the pipe axis.

However, there are several problems with the conventional forming methods.

First, with any forming method other than the press-forming method, the pipe ends cannot be formed simultaneously because one end must be chucked, thus preventing access of such end to the forming dies. In order to form both ends of the pipe, two sequential stages are necessary. Further, after the one end has been formed, the formed end must be chucked by a specially configured chuck when the other end is formed. Thus, changing configurations is not easy. Furthermore, in spinning, a spiral pattern and steps are generated in the surface of the formed member and a step portion is formed in the surface.

Second, the press-forming method requires a very large forming load because the entire circumference of the end of the pipe is formed at the same time as compared with the forming load needed in the methods depicted in FIGS. 9 and 10 wherein the end of the pipe is formed partially and proceeds about the circumference of the annular member. As a result, a large capacity of the forming machine is necessary, which is accompanied by an increase in the equipment cost. Further, the press forming method cannot be used for thickness reduction forming of steel pipe because too much load is necessary. Such a thickness-reduction forming will require heating the pipe to decrease pipe rigidity. The heating will require a scale-deleting step and will increase the production cost.

SUMMARY OF THE INVENTION

An object of the invention is to provide an apparatus and method for forming an annular member wherein axially opposed ends can be formed simultaneously with smaller forming loads than required by the conventional press-forming method.

The above-described object can be achieved by the following apparatus and method for forming an annular member. An annular member is provided having a starting configuration. The annular member is placed on a convex die without chucking the annular member to the convex die. The convex die is moved to relatively approach a concave die inclined with respect to the convex die by a predetermined angle. The concave die is oscillated relative to the convex die wherein axially opposed ends of the annular member are formed simultaneously.

In accordance with the present invention, since the opposed ends of the annular member are not chucked the opposed ends of the annular member are allowed to be formed simultaneously.

Further, since the concave die inclines with respect to the convex die, the forming of the annular member proceeds about the circumference of the annular member due to the oscillation-forming. Then, the entire circumference is formed as the annular member is rotated. As a result, the forming load is smaller than that of the press-forming method wherein the entire circumference is formed simultaneously.

BRIEF DESCRIPTION OF THE PREFERRED EMBODIMENTS

The above and other objects, features, and advantages of the present invention will become more apparent and will be more readily appreciated from the following detailed description of the preferred embodiments of the invention taken in conjunction with the accompanying drawings, in which.

DETAILED DESCRIPTION OF THE PREFERRED EMBODIMENTS

Figure 1:
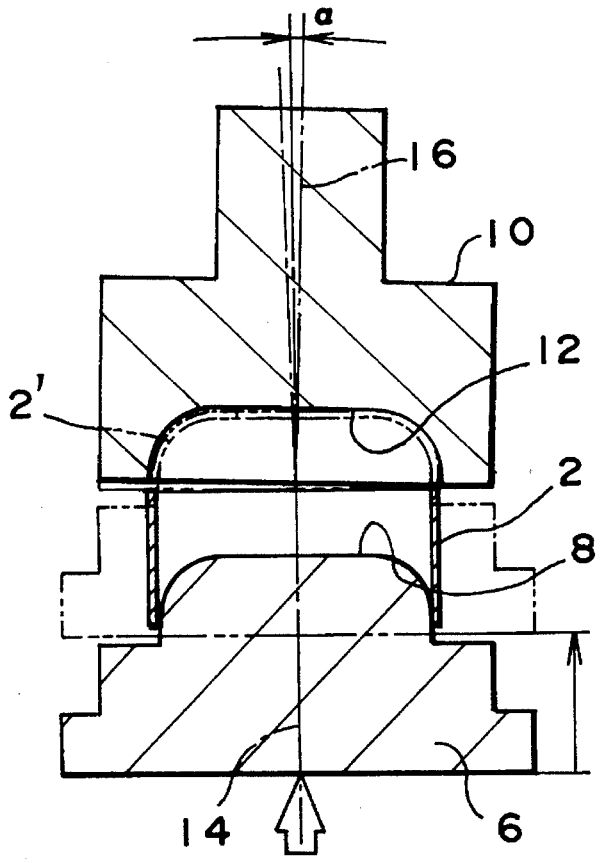
FIG. 1 is a schematic, cross-sectional view of a forming apparatus for forming an annular member in accordance with a first embodiment of the present invention and for conducting a first cycle of a method for forming an annular member in accordance with a third embodiment of the present invention.
Figure 1A:
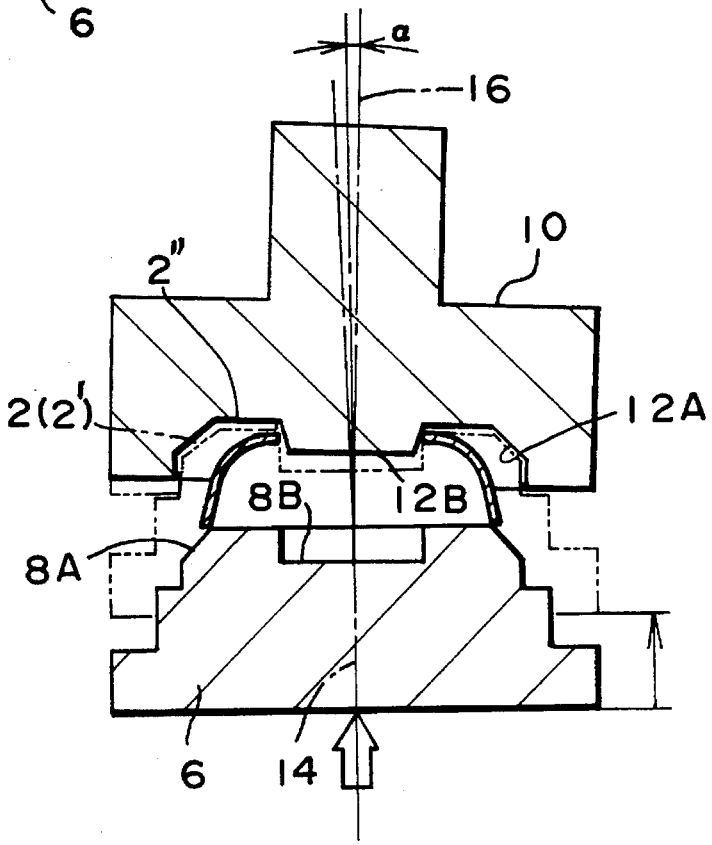
FIG. 1A is a schematic, cross-sectional view of a forming apparatus for conducting a second cycle of the method for forming an annular member in accordance with the third embodiment of the present invention.
Figure 2:
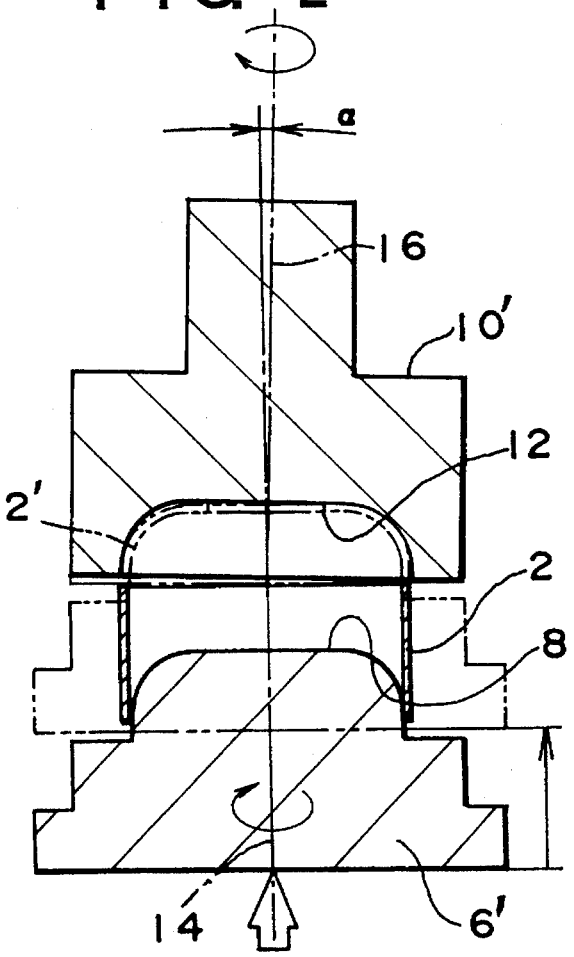
FIG. 2 is a schematic, cross-sectional view of a forming apparatus for forming an annular member in accordance with a second embodiment of the present invention and for conducting a first cycle of a method for forming an annular member in accordance with a fourth embodiment of the present invention.
Figure 2A:
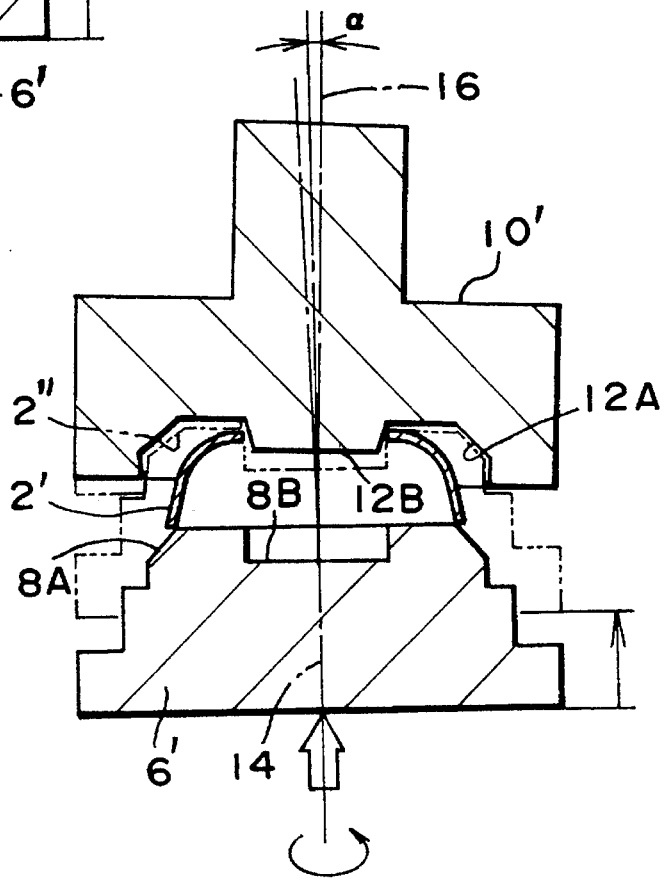
FIG. 2A is a schematic, cross-sectional view of a forming apparatus for conducting a second cycle of the method for forming an annular member in accordance with the fourth embodiment of the present invention.
Figure 3:
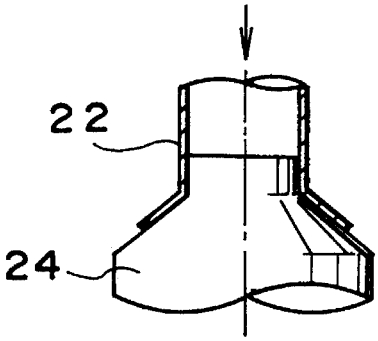
FIG. 3 (PRIOR ART)
FIG. 3 is a partial, cross-sectional view of a conventional apparatus for press-forming a pipe end.
Figure 4:
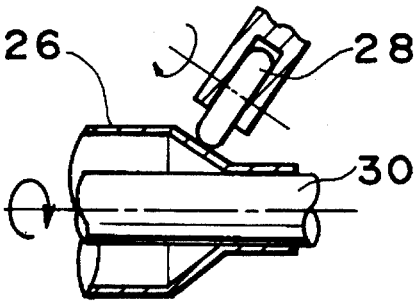
FIG. 4 (PRIOR ART)
FIG. 4 is a partial, cross-sectional view of a conventional apparatus for spinning a pipe.
Figure 5:
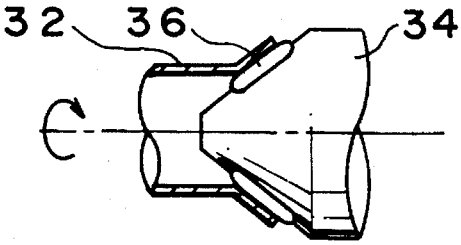
FIG. 5 (PRIOR ART)
FIG. 5 is a partial, cross-sectional view of a conventional apparatus for roller-forming a pipe end.
Figure 6:
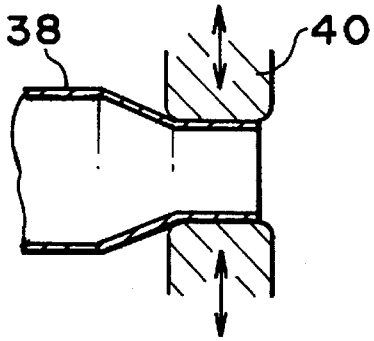
FIG. 6 (PRIOR ART)
FIG. 6 is a partial, cross-sectional view of a conventional apparatus for swaging a pipe end.
Figure 7:
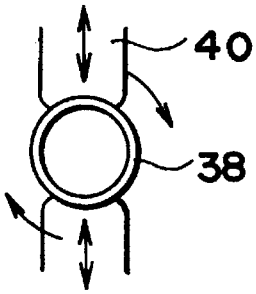
FIG. 7 (PRIOR ART)
FIG. 7 is a transverse, cross-sectional view of the apparatus of FIG. 6.
Figure 8:
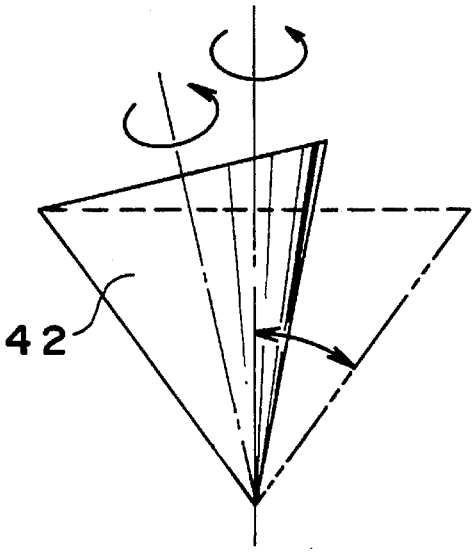
FIG. 8 (PRIOR ART)
FIG. 8 is a front, elevational view of a conventional, oscillating-type forming die and an envelope thereof.
Figure 9:
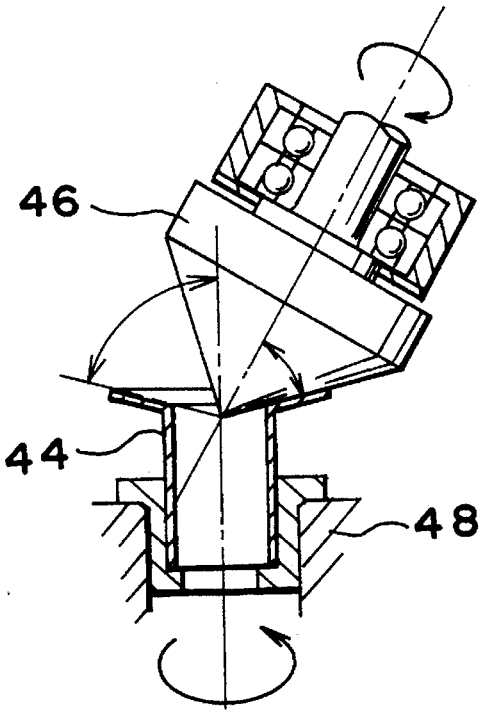
FIG. 9 (PRIOR ART)
FIG. 9 is a partial, cross-sectional view of a conventional oscillating-type forming machine for enlarging a pipe end.
Figure 10:
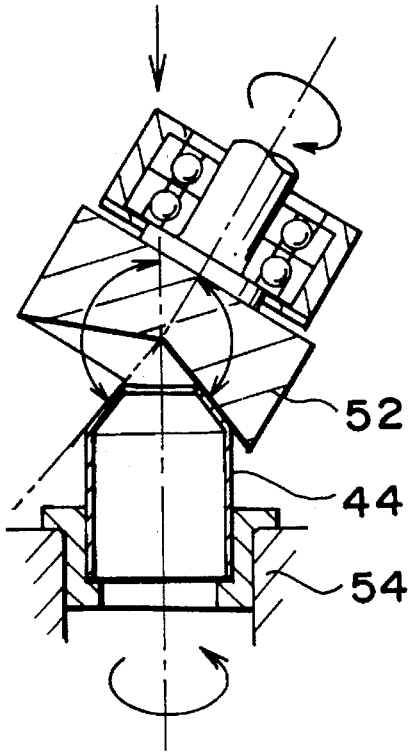
FIG. 10 (PRIOR ART)
FIG. 10 is a partial cross-sectional view of a conventional, oscillating-type forming machine for reducing a pipe end.

Four embodiments of the invention will be explained. The first embodiment is illustrated in FIG. 1, the second embodiment is illustrated in FIG. 2, the third embodiment is illustrated in FIGS. 1 and 1A, and the fourth embodiment is illustrated in FIG. 2 and 2A. The first embodiment and the second embodiment comprise methods for forming an annular member from the starting configuration of a cylinder to a final configuration of a dish having a hole at a central portion of the dish. Such dish is formed by enlarging in diameter one of axially opposed ends of the annular member and reducing in diameter the other end. The third embodiment and the fourth embodiment comprise methods for forming an annular member having a starting configuration of a cylinder, an intermediate configuration of a dish, and a final configuration of a wheel disk.

The first embodiment will be explained with reference to FIG. 1. An annular member 2 has a starting configuration of a cylinder. The annular member 2 has an intermediate diameter between the largest and smallest diameters of an objective configuration of a dish to which the annular member is to be formed. The annular member 2 may be a pipe or cylinder manufactured by rounding a flat plate and butt-welding along the longitudinal seam.

Next, the annular member 2 having the configuration of a cylinder is placed on a forming portion 8 of a convex die 6 without being fixed to the convex die 6. The forming portion 8 of the convex die 6 has a convex forming profile to which the annular member 2 is to be formed. The annular member 2 contacts an intermediate diameter portion of the forming portion 8 of the convex die 6 without being chucked by the convex die 6. The convex die 6 is fixed and does not rotate about an axis 14 of the die 6. Since the annular member 2 is unchucked, it is possible to form axially opposed ends of the annular member simultaneously. Further, since there is no chucking and no chuck-exchanging step in the forming process according to the invention, the forming time period is shortened.

A concave die 10 is provided above the convex die 6. The concave die 10 and the convex die 6 may also be positioned horizontally with respect to each other. The convex die 6 is moved toward and away from the concave die 10. In this configuration, the concave die 10 may also be moved toward and away from the convex die 6.

The concave die 10 inclines relative to the axis 14 of the convex die 6. Thus, an axis 16 of the concave die 10 inclines with respect to the axis 14 of the convex die 6 by a predetermined angle, alpha greater than zero. The axis 14 of the convex die 6 extends in the vertical direction and the axis 16 of the concave die 10 inclines with respect to the vertical direction in the apparatus of FIG. 1. Where the convex die 6 and the concave die 10 are positioned horizontally, the axis of the convex die 6 will extend in a horizontal direction and the axis of the concave die will incline with respect to the horizontal direction.

The concave die 10 has a forming portion 12 which has a concave profile symmetric with respect to the axis 16 of the concave die 10. When the axis 16 of the concave die 10 is revolved around the axis 14 of the convex die 6, the concave die 10 oscillates with respect to the axis 14 of the convex die 6. Though FIG. 1 depicts the lower die as a convex die and the upper die as a concave die, the reverse configuration is permissible.

After the annular member 2 is placed on the convex die 6, the concave die 10 and the convex die 6 are moved so as to squeeze the annular member between the convex die 6 and the concave die 10, so that the forming of the annular member proceeds about the circumference of the annular member. Simultaneously, the concave die 10 is revolved around the axis 14 of convex die 6 so that the concave die 10 oscillates with respect to the axis 14 of the convex die 6. The angle (alpha) between the axis 16 of the concave die 10 and the axis 14 of the convex die 6 is maintained during the revolution. During the oscillation-forming, the contact point between the annular member 2 and the concave die 10 moves about the circumference of the annular member 2. The revolution of the axis 16 of the concave die 10 about the axis 14 of the convex die 6 forms the annular member 2 in the circumferential direction so that the entire circumference of the annular member 2 is oscillation-formed. Due to local forming, the forming load is much smaller than that of the press-forming where an annular member is formed over the entire circumference simultaneously.

The angle between the axis 16 of the concave die 10 and the axis 14 of the convex die 6 is determined to be in the range of 1°–5°. If the angle were smaller than 1°, then the forming load required would be too large because the load would be applied over a relatively long circumferential portion of the annular member. If the angle were greater than 5°, then the support of the annular member between the dies 10 and 6 would be too unstable and the annular member could dislocate from the position between the dies 10 and 6 during formation.

After the distance between the convex die 6 and the concave die 10 reaches a predetermined value, the movement of the one die to the other is stopped. Then, only the revolving motion of the concave die 10 around the axis 14 of the convex die 6 will be continued, maintaining the forming load from the dies 6 and 10 on the annular member 2. After the annular member 2 has been formed to the final configuration of a dish, one of the dies 6 and 10 is moved away from the other and oscillation of the concave die 10 is stopped. Then, the formed annular member 2' is removed from between the convex die 6 and the concave die 10.

Next, the second embodiment of the invention will be explained with reference to FIG. 2. A convex die 6' has an axis 14 and a concave die 10' has an axis 16. The same steps as those of the first embodiment are conducted in the second embodiment except that in the second embodiment, the convex die 6' is forcibly rotated about its axis 14, but axis 16 does not revolve around axis 14. Thus, axis 16 remains inclined with respect to axis 14 of the convex die 6' during the oscillation-forming step. Explanation of the common steps of the second embodiment and the first embodiment will be omitted by denoting the same portions with the same reference numerals as those of the first embodiment.

Next, the third embodiment of the present invention will be explained with reference to FIGS. 1 and 1A. The method in accordance with the third embodiment comprises two cycles of oscillation-formings, wherein in the first cycle an annular member 2 having a starting configuration of a cylinder is formed to an intermediate configuration 2' of a dish, and in the second cycle the intermediate configuration 2' is formed to a final configuration 2" of a wheel disk for an automobile.

In the third method, the annular member 2 with the starting configuration of a cylinder is formed by rounding a flat plate and butt-welding along the longitudinal seam. Conventionally, a disk is manufactured by providing a square flat plate, press-cutting the square plate to a substantially circular plate having a hub hole at a central portion thereof, and press-forming the circular flat plate to a dish-like, wheel disk configuration. However, in the conventional method, the four corner portions and the central hub hole portion of the square plate cannot be used as wheel disk material. In contrast, in the present invention, all portions of the rectangular plate can be used as wheel disk material, thus the method of the present invention is excellent from a material economics viewpoint.

Then, the annular member 2 having the configuration of a cylinder is formed to the intermediate configuration 2' of a dish having a central hole therein, using the forming apparatus of FIG. 1 as discussed in the first embodiment. In the third embodiment, the profiles of the forming portion 8 of the convex die 6 and the forming portion 12 of the concave die 10 are profiles of the intermediate configuration 2' of a dish. Since the steps of forming the annular member 2 from the configuration of a cylinder to the intermediate configuration 2' of a dish are the same as those of the first embodiment, description thereof will be omitted.

Then, the annular member 2 having the intermediate configuration 2' of a dish is formed to the final configuration 2" of a wheel disk using the forming apparatus of FIG. 1A in the way discussed in the first embodiment with reference to FIG. 1. The apparatus of FIG. 1A is the same as that of FIG. 1 except that a forming portion 8A of the convex die 6 and a forming portion 12A of the concave die 10 have a final, wheel-disk profile. Further, in the apparatus of FIG. 1A, the concave die 10 may have a protrusion 12B for entering the hub hole of the annular member 2 to prevent the annular member from dislocating, and the convex die 6 may have a recess 8B to receive the protrusion 12B therein. Since the method of forming the annular member 2 from the intermediate configuration 2' of a dish to the final configuration 2" of a wheel disk of the third embodiment is substantially the same as the method of forming the annular member 2 from the configuration of a cylinder to the configuration of a dish of the first embodiment, description thereof will be omitted.

Next, the fourth embodiment of the present invention will be explained with reference to FIGS. 2 and 2A. The method in accordance with the fourth embodiment comprises two cycles of oscillation-formings, wherein in the first cycle an annular member 2 having a starting configuration of a cylinder is formed to an intermediate configuration 2' of a dish. In the second cycle, the intermediate configuration 2' is formed to a final configuration 2" of a wheel disk for an automobile.

In the final embodiment, during the first cycle, the annular member 2 with the starting configuration of a cylinder is formed by rounding a flat plate and butt-welding along the longitudinal seam. Thus, the same advantage owing to manufacturing the annular member from a flat plate as discussed in the third embodiment is obtained.

Then, the annular member 2 having the configuration of a cylinder is formed to an intermediate configuration 2' of a dish using the forming apparatus of FIG. 2 in the way discussed in the second embodiment. In the fourth embodiment, the profiles of the forming portion 8A of the convex die 6' and the forming portion 12A of the concave die 10' are the profiles of the intermediate configuration 2' of a dish. Since the way of forming the annular member 2 from the configuration of a cylinder to the intermediate configuration 2' of a dish is the same as that of the second embodiment wherein the convex die 6' is forcibly rotated, description thereof will be omitted.

Then, in the second cycle, the annular member 2 having the intermediate configuration 2' of a dish is formed to a final configuration 2" of a wheel disk using the forming apparatus of FIG. 2A in the way discussed in the second embodiment with reference to FIG. 2, wherein the convex die 6' is forcibly rotated. The apparatus of FIG. 2A is the same as that of FIG. 2 except that a forming portion 8A of the convex die 6' and a forming portion 12A of the concave die 10' have a final, wheel disk profile in the apparatus of FIG. 2A, while the forming portion 8 of the convex die 6' and the forming portion 12 of the concave die 10' have an intermediate, dish-like profile. Further, in the apparatus of FIG. 2A, the concave die 10' may have a protrusion 12B for entering the hub hole of the annular member 2 to prevent the annular member from dislocating, and the convex die 6' may have a recess 8B to receive the protrusion 12B therein. Since the method of forming the annular member 2 from the intermediate configuration 2' of a dish to the final, wheel disk configuration 2" of the fourth embodiment is substantially the same as the method of forming the annular member 2 from the cylindrical configuration to the dish-like configuration 2' of the second embodiment, description thereof will be omitted.

In accordance with any embodiment of the present invention, the following advantages are obtained:

First, since the annular member is formed without being chucked, axially opposed ends of the annular member can be formed simultaneously in a single forming step. In formation, one of the axially opposed ends of the annular member is enlarged in diameter and the other is reduced in diameter.

Second, since the annular member is not chucked during formation, change in the forming configuration is easier because no design change of a chucking device is required.

Third, because of oscillation forming, a spiral pattern which would be generated in a spinning method is not generated on a surface of the annular member and thus a stress concentration at such a spiral pattern is prevented.

Fourth, since the portion of the annular member is compressed locally and formation proceeds about the circumference of the annular member, the forming load is much smaller than that of the press-forming method. As a result, the size of the forming machine is smaller.

Last, since the portion of the annular member is compressed locally and formation proceeds about the circumference of the annular member, thickness reduction forming is possible even if the annular member is a steel material which has a relatively large deformation resistance at cold temperatures.

Although four embodiments of the invention have been described in detail above, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. A method for forming an annular member comprising the following steps of:

providing an annular member having a starting configuration; and oscillation-forming the annular member from the starting configuration to an objective configuration by placing the annular member in a starting position on a first die, which includes a portion smoothly changing in diameter between a first diameter larger than a diameter of the annular member and a second diameter smaller than the diameter of the annular member, and then causing the first die to relatively approach a second die which inclines with respect to the first die by a predetermined angle thereby causing the annular member to incline relative to the first die and oscillating the second die relative to the first die wherein the annular member slides axially relative to the first die and the second die to an objective position such that axially opposed ends of the annular member are formed simultaneously so that one of the opposed ends of the annular member is enlarged in diameter by one of the first and second dies and the other of the opposed ends of the annular member is reduced in diameter by the other of the first and second dies.

2. A method according to claim 1, wherein the first die is a convex die and the second die is a concave die.

3. A method according to claim 2, wherein during said annular member providing step, an annular member having the configuration of a cylinder is provided, and during the oscillation-forming step, the concave die is moved so that an axis of the concave die revolves around an axis of the convex die.

4. A method according to claim 2, wherein during said annular member providing step, an annular member having the configuration of a cylinder is provided, and during said oscillation-forming step, the convex die is forcibly rotated about an axis of the convex die.

5. A method for forming an annular member, wherein said method of claim 2 is conducted by two cycles in series using a first-cycle convex die and a first-cycle concave die as said convex die and said concave die, respectively, of a first cycle and using a second-cycle convex die and a second-cycle concave die as said convex die and said concave die, respectively, of a second cycle, and wherein in the first cycle, during said annular member providing step, the annular member having the configuration of a cylinder is provided by rounding a rectangular plate and butt-welding along the longitudinal seam, and during said oscillation-forming step, the first-cycle concave die is revolved around an axis of the first-cycle convex die so that the annular member is formed from the configuration of a cylinder to a configuration of a dish having a hole at a central portion of the dish, and in the second cycle, said annular member providing step provides the annular member having the configuration of a dish, and during said oscillation-forming step, the second-cycle concave die is revolved around an axis of the second-cycle convex die so that the annular member is formed from the configuration of a dish to the configuration of a wheel disk.

6. A method for forming an annular member, wherein said method of claim 2 is conducted by two cycles in series using a first-cycle convex die and a first-cycle concave die as said convex die and said concave die, respectively, of a first cycle and using a second-cycle convex die and a second-cycle concave die as said convex die and said concave die, respectively, of a second cycle, and wherein in the first cycle, during said annular member providing step, the annular member having the configuration of a cylinder is provided by rounding a rectangular plate and butt-welding along the longitudinal seam, and during said oscillation-forming step, the first-cycle convex die is forcibly rotated about an axis of the first-cycle convex die so that the annular member is formed from the configuration of a cylinder to a configuration of a dish having a hole at a central portion of the dish, and in the second cycle, said annular member providing step provides the annular member having the configuration of a dish, and during said oscillation-forming step, the second-cycle convex die is forcibly rotated about an axis of the second-cycle convex die so that the annular member is formed from the configuration of a dish to the configuration of a wheel disk.

7. A method according to claim 1, wherein the predetermined angle defined between the first die and the second die is in the range of 1°–5°.

8. A method according to claim 1, wherein during the annular member oscillation-forming step, the first die which is located below the second die is moved upwardly toward the second die.

9. A method for forming an annular member according to claim 1, wherein the annular member rotates in a circumferential direction during formation.

10. Apparatus for forming an annular member comprising:

a first die having a first axis, on which an annular member is placed in a starting position, the first die having a portion smoothly changing in diameter between a first diameter larger than a diameter of the annual member and a second diameter smaller than the diameter of the annular member;

a second die having a second axis;

means for positioning the first and second dies so that the first and second axes form a non-zero predetermined angle;

means for moving at least one of the first die and the second die so that a point of contact between the first and second dies and the annular member disposed between the first and second dies moves about a circumference of the annular member and so that the annular member inclines relative to the first die and slides axially relative to the first die and the second die to an objective position, the moving means causing the first die and the second die to simultaneously enlarge a diameter of one opposed end of the annular member and reduce a diameter of the other opposed end of the annular member.

11. Apparatus for forming an annular member according to claim 10, wherein the first die includes a convex die and the second die includes a concave die.

12. Apparatus for forming an annular member according to claim 11, wherein the moving means includes a means for oscillating the concave die so that the second axis of the concave die revolves around the first axis of the convex die.

13. Apparatus for forming an annular member according to claim 11, wherein the moving means includes a means for rotating the convex die about the first axis of the convex die.

14. Apparatus for forming an annular member according to claim 10, wherein the positioning means positions the first axis relative to the second axis to form the predetermined angle between 1° and 5°.

15. Apparatus for forming an annular member according to claim 10, wherein the annular member rotates in a circumferential direction during formation.

* * * * *